US005645914A

United States Patent [19]

Horowitz

[11] Patent Number: 5,645,914

[45] Date of Patent: Jul. 8, 1997

[54] ANTI-FATIGUE MAT

[76] Inventor: Allan J. Horowitz, 9640 Bayview Avenue, Suite 1, Richmond Hill, Ontario, Canada, L4C 9P7

[21] Appl. No.: 420,171

[22] Filed: Apr. 11, 1995

[30] Foreign Application Priority Data

Apr. 11, 1995 [CA] Canada ..... 2121023

[51] Int. Cl.[6] ..... B32B 3/02; A47G 9/06

[52] U.S. Cl. ..... 428/81; 428/88; 428/91; 428/95; 428/172; 428/192; 428/318.8; 5/417; 5/420

[58] Field of Search ..... 428/150, 81, 83, 428/68, 88, 91, 71, 95, 192, 218, 318.4, 318.8, 172; 5/420, 417; 15/215

[56] References Cited

U.S. PATENT DOCUMENTS

| | | | |
|---|---|---|---|
| 1,271,005 | 7/1918 | Bartlett | 428/82 |
| 3,014,829 | 12/1961 | Curtin | 428/82 |
| 3,711,362 | 1/1973 | Ballard | 428/167 |
| 4,361,925 | 12/1982 | Yamamoto et al. | 428/82 |
| 4,810,560 | 3/1989 | Sell | 428/88 |
| 5,024,868 | 6/1991 | Petersen | 428/88 |

*Primary Examiner*—Donald Loney
*Attorney, Agent, or Firm*—Philip C. Mendes da Costa; Bereskin & Parr

[57] ABSTRACT

A mat adapted to relieve fatigue in a person standing on it without shoes or boots, and formed from fine cell foam having a density of between 1.5 and 2.5 pounds per cubic foot, with thickness between 0.75 and 1.5 inches, and a compression strength at 25% compression of between 10 and 17 p.s.i. The mat has sloping edges and is covered by carpet. When a person in bare or stocking feet stands on the mat, the mat partially compresses but has remaining resiliency such as to produce a swaying motion in the person. This results in increased muscle action and blood circulation in the feet, legs and hips and some spinal movement, reducing fatigue.

8 Claims, 1 Drawing Sheet

ANTI-FATIGUE MAT

FIELD OF THE INVENTION

This invention relates to an anti-fatigue mat. More particularly it relates to an anti-fatigue mat adapted to be used by a person who is not wearing shoes or boots.

BACKGROUND OF THE INVENTION

Anti-fatigue mats are sometimes used in factories and other workplaces, to decrease foot fatigue for workers who stand in one position for prolonged periods. Such mats have commonly simply been a thin rubber or foam mat. So far as is known, none has been designed to take into account the forces acting on the foot and which are transmitted to other parts of the body. In addition none has been designed for use by a person in bare or stocking feet or thin flexible slippers.

Therefore it is an object of the present invention to provide an anti-fatigue mat suitable for use by a person who is not wearing boots or shoes, and which has parameters designed for substantially reducing fatigue when a person stands on the mat for a prolonged period.

BRIEF SUMMARY OF THE INVENTION

In one of its aspects the present invention provides a mat adapted to relieve fatigue in a person standing thereon without shoes or boots, comprising:

(a) a central portion having a substantially planar upper surface and a substantially planar lower surface parallel to said upper surface, (b) a border portion extending around said central portion and forming a downwardly sloping edge around said central portion, (c) said border portion sloping at an angle of between 10° and 80° with respect to the plane of said top and bottom surfaces, (d) said central and border portions being formed integrally of a resilient flexible foam, said foam having a thickness of between 0.75 and 1.5 inches, a density of between 1.5 and 2.5 pounds per cubic foot, and a compressive strength at 25% compression of between 10 and 17 pounds per square inch, (e) and a thin carpet material surfacing said central and border portions and extending without seams across said central and border portions.

Further objects and advantages of the invention will appear from the following description, taken together with the accompanying drawings.

DETAILED DESCRIPTION OF PREFERRED EMBODIMENTS

When a person stands, such person must constantly use various muscle groups to maintain his/her balance. Balance is maintained in an anterior-posterior direction primarily by the plantar flexor muscles of the foot, and in a medial-lateral direction by the hip abductor and adductor muscles. Because the center of gravity of a human is approximately 2 inches anterior to the ankle joint, the plantar flexor muscles of the foot and ankle are the most important muscles involved in this "balancing" process. These muscles are constantly in a dynamic state, contracting and relaxing as needed to "balance" the body's center of gravity.

When the person is standing on a hard surface, the center of gravity of his/her body does not dynamically change to any substantial degree. Therefore the muscles involved are not particularly active. The inactivity and consequent lack of blood flow through and around the joints creates, over time, a feeling of fatigue.

When the person stands on a softer surface, there is more sway of the body, more motion of the center of gravity, and therefore more change needed in the correction system for balance. This requires more constant motion in the person's muscles. The increased muscle activity produces a "massaging" of the joints on which they act, as well as an increased blood circulation through and around the same joints. The increased muscular activity occurs in the ankle and foot and also in the knees, upper and lower legs, and hips. The increased muscular activity in these portions of the body promotes the above-mentioned beneficial effect in these areas.

In addition, because the increased body sway associated with the softer support surface causes more horizontal motion of the pelvis, portions of the body above the pelvis (e.g. the spine) also benefit by the increased muscular activity associated with the swaying motion.

Figure 1:
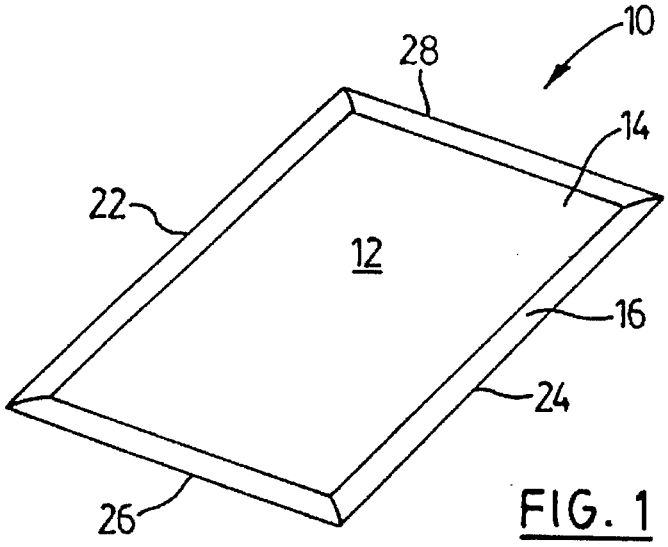
FIG. 1 is a perspective view of a mat according to the invention.
Figure 2:
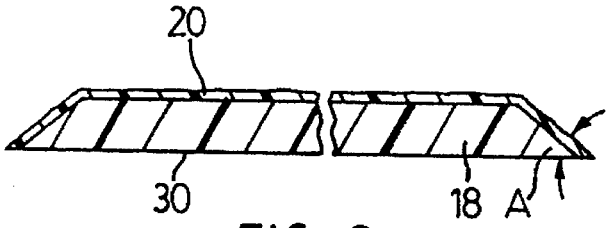
FIG. 2 is a sectional view taken along lines 2—2 of the mat of FIG. 1.

According to the invention therefore, a mat is provided having parameters which will promote body sway, in order to cause a constant changing of the center of gravity of the user. Reference is therefore made to FIGS. 1 and 2, which show a mat 10 according to the invention. Mat 10 has a central portion 12 having a substantially planar upper surface 14. The central portion 12 is surrounded by a border 16 which forms a bevelled edge around the central portion 12.

As shown in FIG. 2, the mat 10 is formed primarily from a suitable resilient plastic foam 18, the parameters of which will be described shortly. The foam 18 extends throughout the central portion 12 and the border 16 and its upper surface is covered by a continuous layer of carpet 20. The carpet 20 extends without any discontinuities across the width of the mat 10 between edges 22, 24, and between edges 26, 28. The carpet 20 may be any durable, relatively stain resistant low pile carpet, e.g. of nylon.

The mat 10 is primarily intended for work areas such as kitchens and other locations where persons may stand without shoes. The angle A between the border 16 and the horizontal plane of the bottom 30 of the mat should be sufficiently shallow that users will not trip or stub their toes on the mat when they walk towards and onto it. Angle A may be between 10° and 80°, preferably between 30° and 60°, and most preferably 45°.

The parameters of the foam 18 are particularly important. The foam 18 should be of a thickness and resiliency sufficient to cause a slight swaying motion of the body when a person is standing on the mat. The foam should not be so stiff as in effect to constitute a hard surface, since then the beneficial effects of the mat would be lost or greatly diminished. However the foam 18 should not be so soft that it allows the user's foot in effect to descend virtually to the floor 32 on which the mat is placed, since that also would defeat the purpose of the mat. The user would then, in effect, again be standing on a hard surface.

Figure 3:
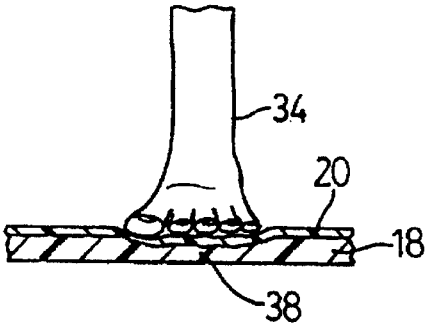
FIG. 3 is a diagrammatic view of a leg of a person standing on the mat of FIGS. 1 and 2.

Preferably the foam should, when a user is standing on it, assume the condition shown in FIG. 3, in which it is partially but not fully compressed by a foot 34. In this condition the foam thickness, indicated by reference numeral 36, under the user's foot 34 can compress further as the foot rocks from side to side or front to rear, promoting the balancing action described above.

Assuming a weight for an average person as being between 100 and 200 pounds, it is found that the thickness of the foam 18 should be between 0.75 inches and 1.5 inches using a cross-linked fine cell polyethylene foam. A foam particularly suitable for this purpose is the foam sold under the trade mark MICROCELL by Polyfab of Mississauga, Ontario, Canada as its brand SENTINEL SS-20. Such foam has a density of 2 pounds per cubic foot, a compression strength at 25% of 13.5 p.s.i., and a compression set at 50% compression of 11%. Its tear resistance is 10 pounds per linear inch; its tensile strength is 68 p.s.i., and its elongation at break is 127%.

The compression strength at 25% is determined using ASTM's standard designation D35735-77 and simply measures the force necessary to produce a 25% compression (i.e. reduction in thickness) over the entire top area of the foam specimen. The compression set is a measure of the constant deflection, expressed as a percentage of the original deflection, remaining after the original thickness has been compressed by 50%.

While the density of the foam 18 is preferably about 2 pounds per cubic foot, such density may vary between approximately 1.5 and 2.5 pounds per cubic foot.

Similarly, while the compression strength is preferably about 13.5 p.s.i. at 25% compression, this may vary between about 10 and 17 p.s.i.

The compression set for the foam used was, as mentioned, 11% but this may vary from 0% to about 20%. A higher compression set is undesirable since it tends to destroy the resilience of the mat.

The carpet 20 used adds additional thickness to the mat, above that described. Since too much thickness is undesirable (because the mat represents a discontinuity on an otherwise flat floor), the carpet should be as thin as possible, consistent with having adequate strength and durability.

With the parameters described, it is found that when a person whose weight is in the range described steps on the mat, it will compress partially but not fully and will have sufficient thickness 36 beneath the user's foot to stimulate a dynamic balancing action which reduces fatigue.

By way of example, assume that a person standing on the mat 10 weighs 150 pounds and that each foot of such person has an area of about 35 square inches. Of course the bottom of the foot is not flat. Accordingly, the initial contact area may be only ¼ of this area or about 8.75 square inches per foot. Often standing persons rock slightly, shifting most of their weight from one foot to the other and then back again, so the effective total contact area may range from about 8.75 square inches (initial contact area of one foot) to about 70 square inches (both feet resting fully on the mat).

The pressure on the mat will then range from about 150÷8.75=17.1 p.s.i. (one foot, initial contact), down to about 150÷70=2.1 p.s.i. (two feet planted firmly and fully on the mat). The higher pressure will produce more than a 25% compression of the mat while the lower pressure will produce a much lower compression. While a heavier person will exert more force on the mat, usually such a person will have larger feet so the pressure on the mat will not normally greatly exceed about 17 p.s.i. Preferably the mat will always have a compression strength such that it does not compress by more than about ½, more preferably by only about ⅓ and most preferably by only about n , when the average person stands on it, since if a greater compression occurs, the compressed mat will become too hard to produce the desired swaying effect. However the compression strength should be low enough that the mat compresses to a reasonable extent, preferably by at least 5%, when the average person stands uniformly on it with two feet, since if the mat is too hard, it also will not produce the desired swaying effect.

The figures referred to above do not include the thickness or compression strength of the carpet 20. Normally compression of the carpet will be negligible.

Figure 4:
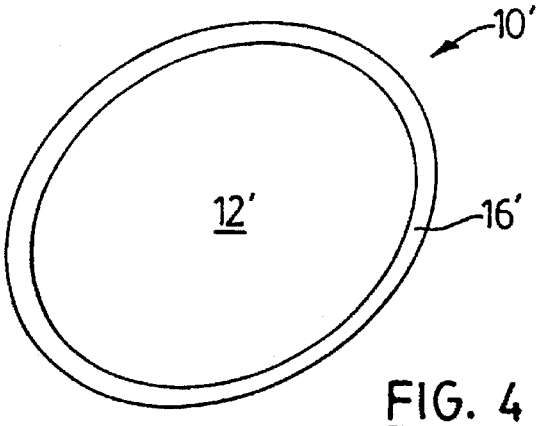
FIG. 4 is a perspective view of a modified mat according to the invention.

The mat 10 may be made in various sizes, typically 2 feet by 3 feet for kitchens, ranging up to 3 feet by 10 feet or more for larger areas. In addition, rather than being rectangular, the mat can assume other shapes, e.g. an oval shape as shown for mat 10' in FIG. 4. In all cases the border of the mat will be shaped as described, and the entire upper surface of the mat will be covered by a layer of carpet which has no discontinuities. The carpet can be secured to the foam by any compatible adhesive, and the edges of the carpet can be sewn at the edges 22, 24, 26, 28 by a suitable thread.

The bottom surface 30 of the foam will normally have a non-skid surface but can be provided with an additional non-skid coating if desired.

While preferred embodiments of the invention have been described, it will be appreciated that various changes can be made, and all such changes within the spirit of the invention are intended to be within the appended claims.

I claim:

1. A mat adapted to relieve fatigue in a person standing thereon without shoes or boots, comprising:

(a) a central portion having a substantially planar upper surface and a substantially planar lower surface parallel to said upper surface, (b) a border portion extending around said central portion and forming a downwardly sloping edge around said central portion, (c) said border portion sloping at an angle of between 10° and 80° with respect to the plane of said top and bottom surfaces, (d) said central and border portions being formed integrally of a resilient flexible foam, said foam having a thickness of between 0.75 and 1.5 inches, a density of between 1.5 and 2.5 pounds per cubic foot, and a compressive strength at 25% compression of between 10 and 17 pounds per square inch, (e) and a thin carpet material surfacing said central and border portions and extending without seams across said central and border portions.

2. A mat according to claim 1 wherein said thickness is between 1 and 1.5 inches.

3. A mat according to claim 2 wherein said angle is approximately 45°.

4. A mat according to claim 2 wherein said density is approximately 2 pounds per cubic foot.

5. A mat according to claim 2 wherein said compression strength at 25% compression is approximately 13.5 pounds per square inch.

6. A mat according to claim 5 wherein said mat is rectangular.

7. A mat according to claim 5 wherein said mat has rounded ends.

8. A mat according to claim 5 wherein said mat is rectangular and is of dimension approximately 2 feet by 3 feet.

* * * * *